US009415902B2

(12) United States Patent
Clark

(10) Patent No.: US 9,415,902 B2
(45) **Date of Patent: *Aug. 16, 2016**

(54) CLAMSHELL FOOD TRAY

(71) Applicant: Ronald Clark, Oakley, CA (US)

(72) Inventor: Ronald Clark, Oakley, CA (US)

( * ) Notice: Subject to any disclaimer, the term of this patent is extended or adjusted under 35 U.S.C. 154(b) by 32 days.

This patent is subject to a terminal disclaimer.

(21) Appl. No.: 13/902,374

(22) Filed: May 24, 2013

(65) Prior Publication Data

US 2014/0110280 A1 Apr. 24, 2014

Related U.S. Application Data

(63) Continuation-in-part of application No. 13/008,867, filed on Jan. 18, 2011.

(60) Provisional application No. 61/295,595, filed on Jan. 15, 2010.

(51) Int. Cl.

| | |
|---|---|
| ***B65D 1/24*** | (2006.01) |
| ***A47G 19/00*** | (2006.01) |
| ***B65D 25/56*** | (2006.01) |
| ***B65D 43/16*** | (2006.01) |
| ***B65D 1/36*** | (2006.01) |

(52) U.S. Cl.
CPC *B65D 25/56* (2013.01); *B65D 1/36* (2013.01); *B65D 43/162* (2013.01)

(58) Field of Classification Search
CPC ..... B65D 1/36; B65D 43/162; B65D 71/72
USPC ..... 220/4.23, 703, 737–742, 592.09, 592.1, 220/592.2, 592.23, 592.25, 23.87, 556, 575, 220/4.21, 4.22, 503, 509–516, 521, 662, 220/377, 602; 229/406, 407, 100, 5.8; 206/562–564; 215/386
See application file for complete search history.

(56) References Cited

U.S. PATENT DOCUMENTS

| | | | | | |
|---|---|---|---|---|---|
| 1,367,248 | A | * | 2/1921 | Goldman et al. | 220/789 |
| 2,456,610 | A | * | 12/1948 | Baker | 206/562 |
| 3,542,280 | A | * | 11/1970 | Crabtree | 206/561 |
| 5,533,639 | A | * | 7/1996 | Myers | 220/23.8 |
| 5,857,583 | A | * | 1/1999 | Chantaca et al. | 220/523 |
| 6,129,232 | A | * | 10/2000 | Williams | 220/521 |
| D622,139 | S | * | 8/2010 | Marcott et al. | D9/418 |
| 2010/0072206 | A1 | * | 3/2010 | Doyle | 220/345.2 |
| 2010/0308039 | A1 | * | 12/2010 | Miros et al. | 220/4.22 |

* cited by examiner

*Primary Examiner* — Shawn M Braden
(74) *Attorney, Agent, or Firm* — West & Associates, A PC; Stuart J. West; Shaon N. Sloman

(57) ABSTRACT

A clamshell food tray. In some embodiments, the clamshell food tray can comprise a window such that a viewer can see into the interior of the clamshell food tray when the clamshell food tray is in a closed configuration. In some embodiments, the clamshell food tray can have apertures configured to accept a beverage container.

10 Claims, 7 Drawing Sheets

CLAMSHELL FOOD TRAY

CLAIM OF PRIORITY

The following application is a continuation-in-part of U.S. patent application Ser. No. 13/008,867, filed Jan. 18, 2011, which claimed priority to U.S. Provisional Patent Application No. 61/295,595, filed Jan. 15, 2010, and the complete contents of both are hereby incorporated by reference.

BACKGROUND

1. Field of the Invention

The present disclosure relates to food containers, specifically clamshell-style food trays.

2. Background

Disposable plates and food trays are often used at social gatherings such as parties, sporting events, and business functions, as they offer a convenient way to provide tableware without having to worry about tedious clean-up. In many instances, it is desirable to have clamshell trays with lids to protect food from pests and/or maintain an ideal temperature, especially when outdoors. However, it can be cumbersome for a user to separately carry a beverage container in addition to a traditional food tray, especially in settings when the user is holding the food tray with one hand and cannot easily eat from the food tray with the other hand because the other hand must hold the beverage container. Additionally, it can be difficult for users to determine the contents of traditional clamshell food trays without opening the lid of the food tray.

What is needed is a clamshell food tray that addresses these issues. In some embodiments, the food tray can have a window that allows users to view into the interior of the food tray to determine its contents. Also, in some embodiments, the food tray can have an aperture configured to hold a beverage container when the food tray is in either an open or closed configuration, such that a user need not use both hands when trying to hold the food tray and a also a separate beverage container. In some embodiments, a beverage container can act as the closure mechanism for the tray when the beverage container is engaged with the food tray.

DETAILED DESCRIPTION

Figure 1:
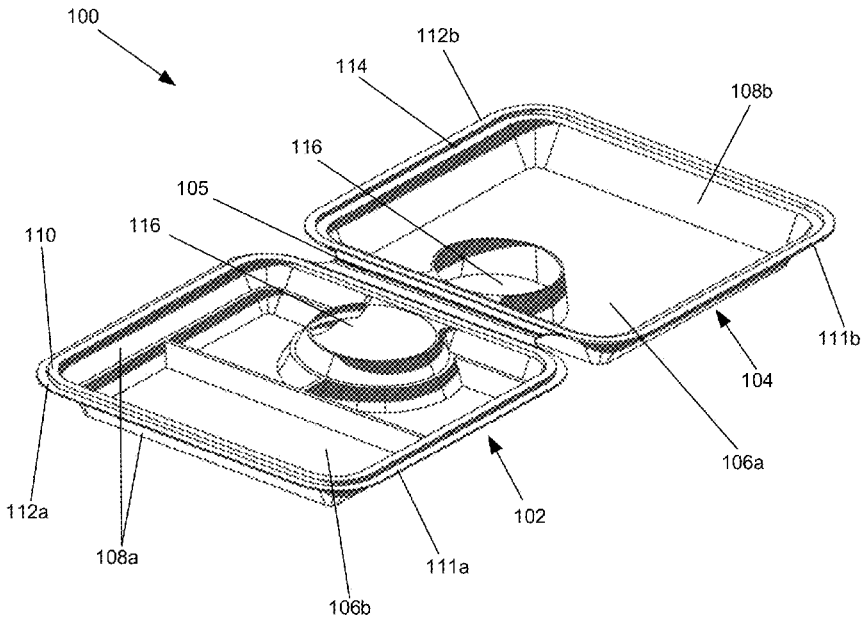
FIG. 1 depicts a perspective view of an embodiment of a container in an open configuration.

FIG. 1 depicts an embodiment of a container 100. A container 100 can have a first section 102 and a second section 104 coupled via a hinge mechanism 105. A first section 102 and a second section 104 can each comprise at least one tray member 106 having sidewalls 108. A first section 102 can further comprise a raised lip 110 coupled with sidewalls 108*a*, and a first rim 112*a* coupled with a raised lip 110, thus forming a first perimeter edge 111*a*. A second section 104 can further comprise a recessed ledge 114 coupled with sidewalls 108*b*, and a second rim 112*b* coupled with a recessed ledge 114, thus forming a second perimeter edge 111*b*. In alternate embodiments, the second section 104 can comprise a raised lip 110 and the first section can comprise a recessed ledge 114.

Figure 2:
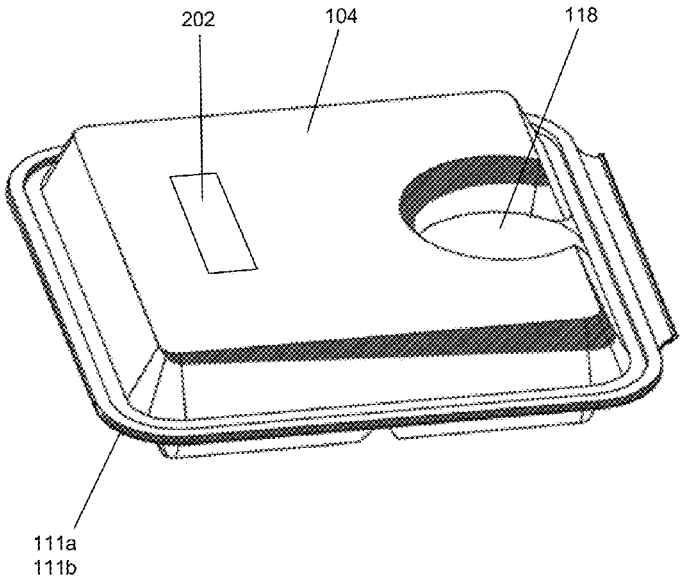
FIG. 2 depicts a perspective view of an embodiment of a container in a closed configuration.

At least one section 102 or 104 can comprise an aperture 116. FIG. 1 depicts an embodiment of a container 100 wherein each section 102 and 104 can have an aperture 116. In the embodiment shown, apertures 116 can be located proximate to a hinge mechanism 105 such that when a container 100 is in a closed configuration (as shown in FIG. 2), a single opening 118 can be formed. In other embodiments, at least one aperture 116 can be located in any other desired and/or convenient location in a container 100.

A section 102 or 104 can have a relatively squared geometry, as depicted in FIG. 1. However, in other embodiments, a section 102 and/or 104 can be rectangular, ovoid, circular, triangular, or can have any other known and/or convenient geometry. Sections 102 and/or 104 can have smooth surfaces, or can have textured surfaces. The exterior surfaces of a section 102 and/or 104 can comprise one or more colors, designs, or any other desired aesthetic feature, and/or can comprise antibacterial and/or antimicrobial coating or properties. In some embodiments, at least a portion of the exterior surface of a section 102 and/or 104 can comprise anti-slip properties and/or coating.

Figure 3:
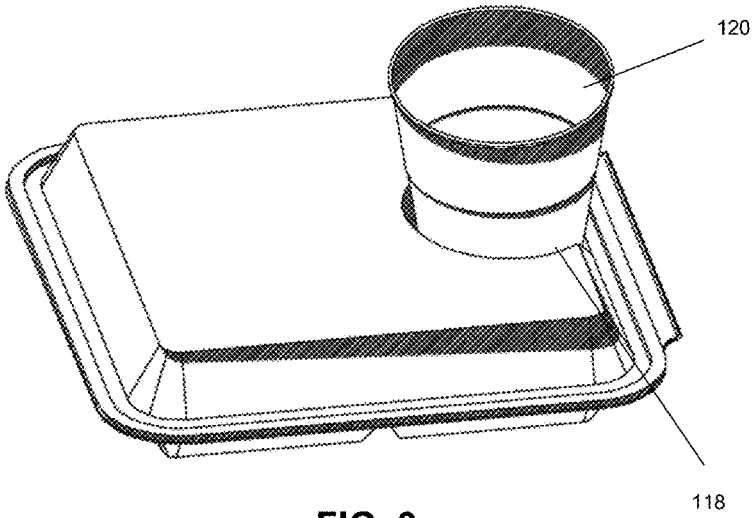
FIG. 3 depicts a perspective view of an embodiment of a container in a closed configuration with a cup inserted in an opening.

In some embodiments, an opening 118 can be adapted to receive at least a portion of a cup 120, as shown in FIG. 3. In some embodiments, a cup 120 inserted in an opening 118 can keep a container 100 in a closed configuration (i.e., first and second sections 102 104 are coupled with each other with the first and second perimeter edges 111*a* 111*b* in contact with one another). In other embodiments, as described below, a container 100 can be temporarily secured in a closed configuration in any other known and/or convenient manner or via any other known and/or convenient mechanism.

Figure 5:
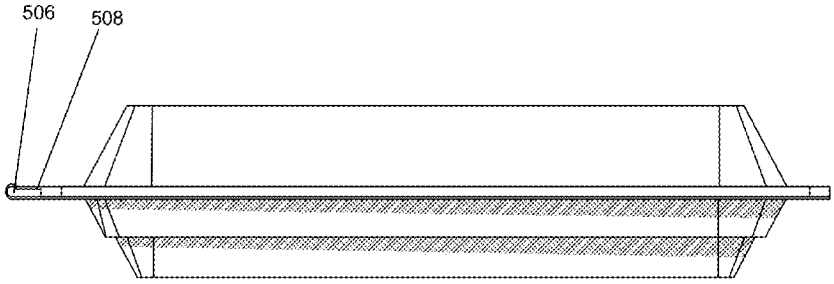
FIG. 5 depicts a side view of an embodiment of a container having at least one tab member configured to selectively couple the tray members.

First and second perimeter edges 111*a* 111*b* can be adapted to selectively couple with each other when pressed together, such that a lip 110 can be in contact with a ledge 114, and first and second rims 112*a* 112*b* can be in contact with each other. In some embodiments, a container 100 can be temporarily secured in a closed configuration via interference fit between first and second perimeter edges 111*a* 111*b*. In some embodiments, this interference fit closure can be the sole method of closure for a container 100. In other embodiments, the cup-closure mechanism described above can be used to keep a container 100 in a closed configuration. In alternate embodiments, a container 100 can be temporarily secured in a closed configuration via one or more tab members 506 inserted into slits 508 along a first and/or second perimeter edge 111*a* 111*b*, as shown in FIG. 5. In yet other embodiments, a container 100 can be temporarily secured in a closed configuration via any other known and/or convenient mechanism, including but not limited to: a latch, reusable adhesive, or hook and loop fastening components.

Figure 4:
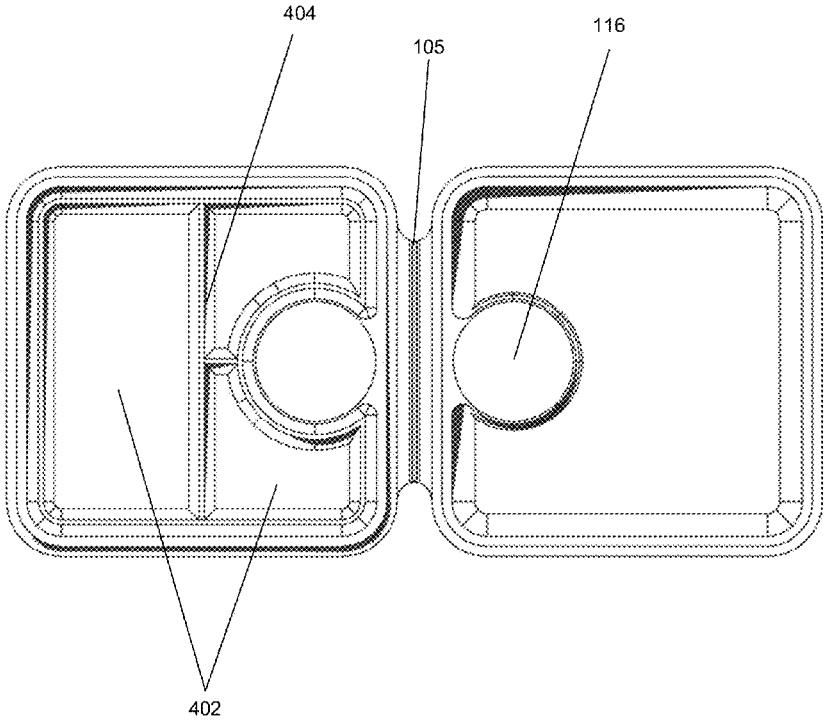
FIG. 4 depicts a top view of an embodiment of a container in an open configuration.
Figure 6:
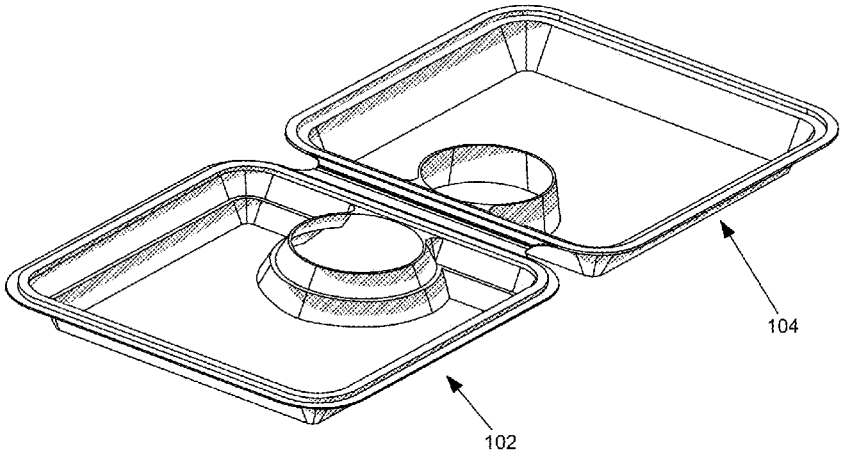
FIG. 6 depicts a perspective view of an embodiment of a container in an open configuration, without dividers.
Figure 7:
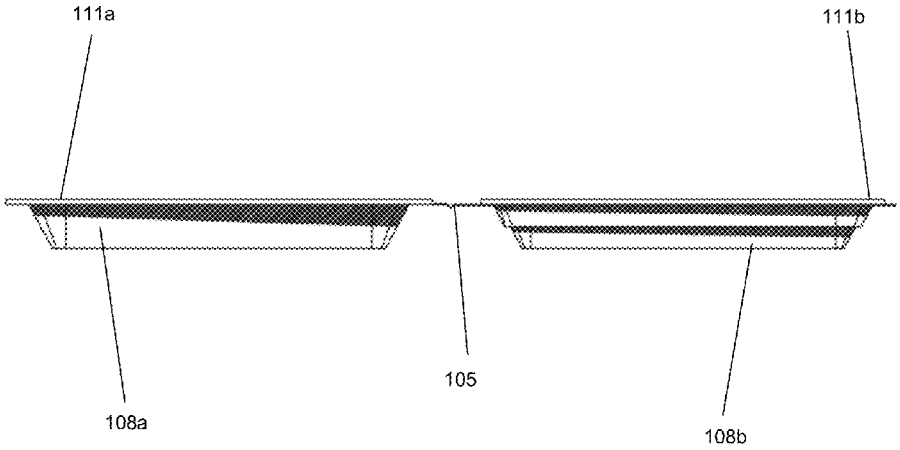
FIG. 7 depicts a side view of an embodiment of a container in an open configuration.

As depicted in FIG. 4, at least one section 102 104 can further comprise a plurality of compartments 402 formed by raised dividing members 404 coupled with a tray member 106. Compartments 402 can be used to separate foods or other objects. However, in other embodiments, both sections 102 and 104 can be devoid of raised dividing members 404, as depicted in FIG. 6.

A container 100 can be at least partially comprised of paper, corn products, recycled materials, plastic, environmentally-friendly materials, or any other known and/or convenient material or combination of materials. A container 100 can also have insulating properties, can be made of food-grade material, can be water impermeable (such that liquids cannot leak through), and/or can be biodegradable. In some embodiments, and as shown in FIG. 2, the exterior surface of at least one section 102 104 can have a label 202 that can be used to identify the contents of a container 100, a person's name, or any other known and/or convenient identifier. In other embodiments, a container 100 can further comprise a utensil holder.

In use, and according to the embodiment depicted in FIG. 1, a user can place food on a tray member 106*a* when a container 100 is in an open configuration. In embodiments having compartments 402, a user can divide food or other objects amongst compartments 402. The user can then bring a second section 104 over a first section 102 such that first and second perimeter edges 111*a* 111*b* can be in contact with each other. In some embodiments, a user can then press perimeter edges 111*a* 111*b* together to temporarily couple sections 102 104. A user can also insert a cup 120 into an opening 118 such that a cup 120 can hold sections 102 104 together, as depicted in FIG. 3.

Figure 8A:
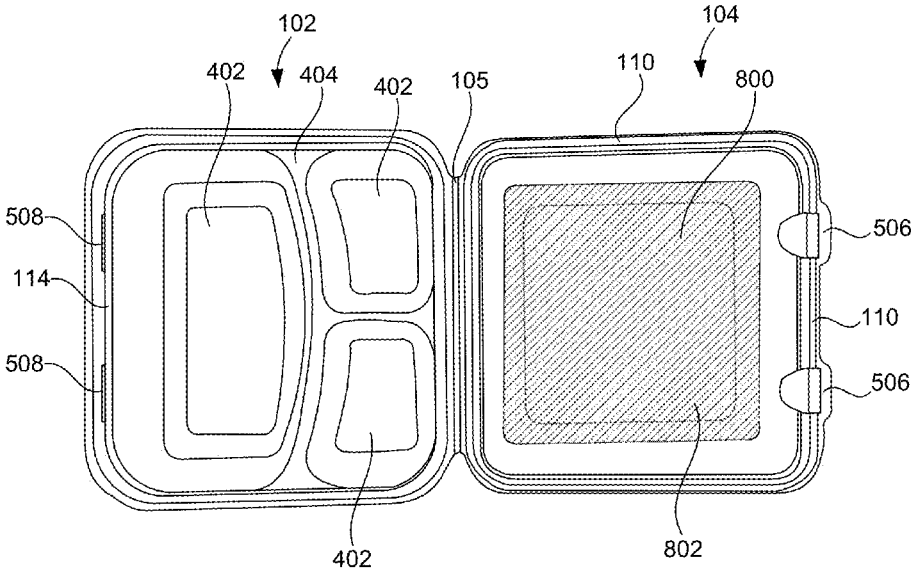
FIG. 8A depicts a top view of an embodiment of a container in an open configuration, the container comprising a window.
Figure 8B:
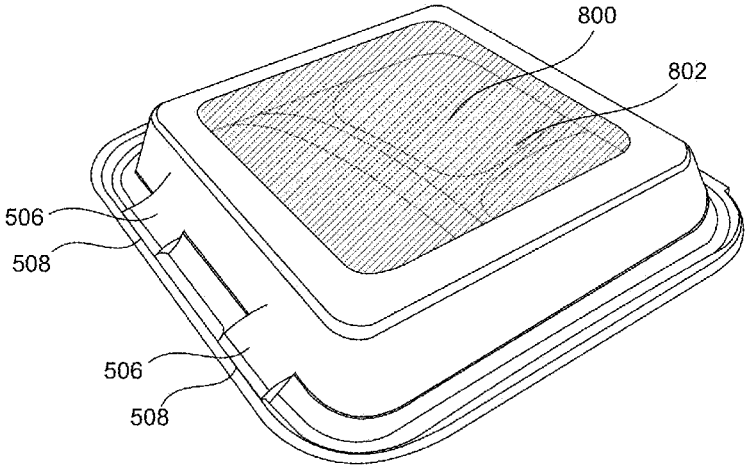
FIG. 8B depicts a perspective view of an embodiment of a container in a closed configuration, the container comprising a window.
Figure 9A:
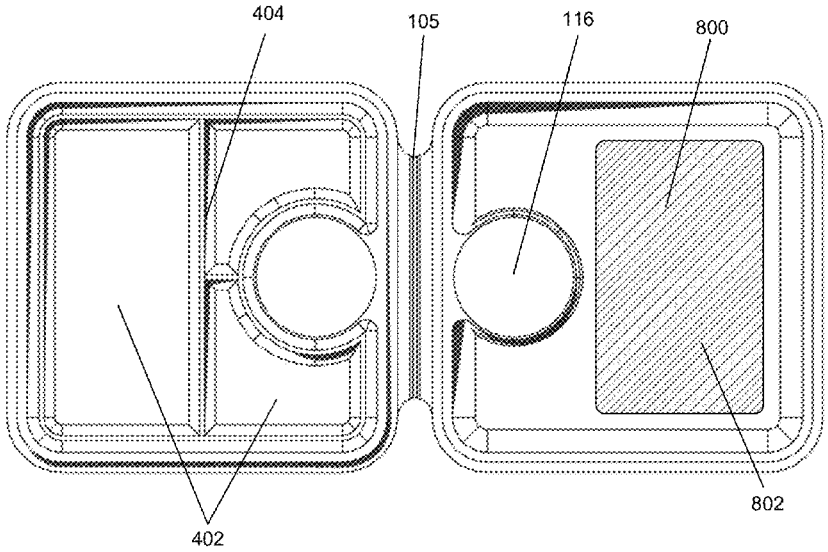
FIG. 9A depicts a top view of an embodiment of a container in an open configuration, the container comprising a window and an opening for a beverage container.
Figure 9B:
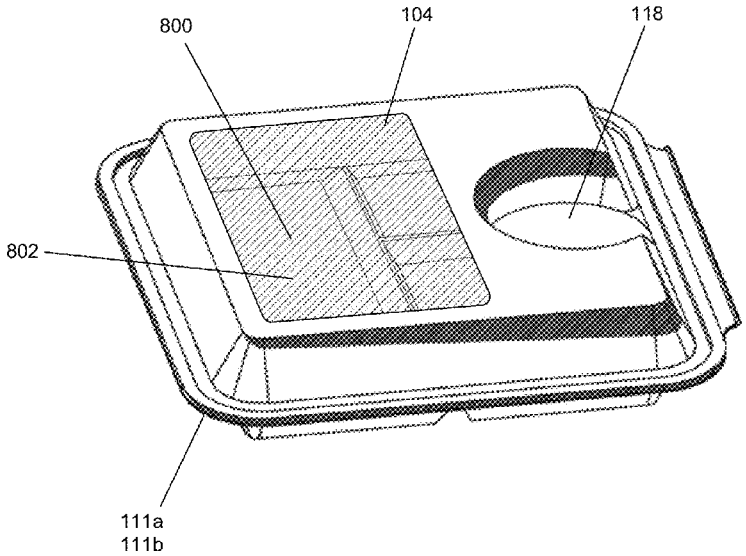
FIG. 9B depicts a perspective view of an embodiment of a container in a closed configuration, the container comprising a window and an opening for a beverage container.

FIGS. 8A, 8B, 9A, and 9B depict alternate embodiments of containers 100 having windows 800. In some embodiments, the first section 102 and/or second section 104 can comprise one or more windows 800. By way of a non-limiting example, FIGS. 8A and 8B depict an embodiment of a container in which the second section 104 has a window 800. FIG. 8A depicts a top view of an open container 100 having a window 800, and FIG. 8B depicts a perspective view of a closed container 100 having a window. Similarly, FIG. 9A depicts a top view of an open container 100 having a window 800, and FIG. 9B depicts a perspective view of a closed container 100 having a window.

In some embodiments, the container 100 can have one or more windows 800, and apertures 116 that form openings 118 for beverage containers 120 can be absent, as shown in FIGS. 8A and 8B. In other embodiments, the container 100 can have one or more windows 800, and can also have apertures 116 that form openings 118 for beverage containers 120 as discussed above, as shown in FIGS. 9A and 9B. The apertures 116 and opening 118 can be proximate to the hinge mechanism 105 as shown in FIGS. 9A and 9B, or can be located at any other desired position in the container 100. In still other embodiments, the window 800 can be absent, as shown in FIGS. 1-7.

The window 800 can comprise a panel 802 that fills a window opening in the first section 102 or second section 104. The window 800 can allow a viewer to look through the panel 802 into the interior of the container 100 when the container 100 is in a closed configuration. By way of a non-limiting example, a user can look through the window 800 to view the contents of the container 100. The panel 802 can be a transparent or translucent member that encloses the window opening in the first section 102 or second section 102 to form the window 800. In some embodiments, the panel 802 can be a clear plastic sheet. In other embodiments, the panel 802 can be cellophane, film, mesh, glass, acrylic, polymeric material, or any other desired material. In some embodiments, the panel 802 can be coupled with the first section 102 or second section 104 at the edges of the window opening with adhesives, tape, fasteners, or any other desired connection method. In alternate embodiments, the panel 802 can be positioned between different layers of the first section 102 or second section 104.

In some embodiments, the window 800 can be substantially the same shape as the general shape of the top or bottom surface of the first section 102 or second section 104. By way of a non-limiting example, the window 800 shown in FIGS. 8A and 8B is substantially rectangular and matches the generally rectangular shape of the top of the second section 104. By way of another non-limiting example, in embodiments having an opening 118, the window 800 can be substantially straight on three sides, with the fourth side contoured to match the contours of an aperture 116 in the top of the second section 104. In other embodiments, the window 800 can be circular, ovoid, rectangular, square, polygonal, have the shape of a logo or other design, or have any other desired shape. By way of a non-limiting example, the window 800 shown in FIGS. 9A and 9B is substantially rectangular and is positioned on the top of the second section 104 away from the opening 118.

As discussed above, the container 100 can be folded at the hinge mechanism 105, and the second perimeter edge 111*b* can be put in contact with the first perimeter edge 111*a* to put the container 100 in a closed configuration. As discussed above, in some embodiments one of the first section 102 or second section 104 can have one or more tabs 506 on a perimeter edge 111 that can be inserted into one or more slits 508 in the perimeter edge 111 of the other one of the first section 102 or second section 104 to keep the container 100 in the closed configuration, as shown in FIG. 8B. In other embodiments that have apertures 116 that form an opening 118, the tabs 506 and slits 508 can be absent, and the presence of a beverage container 120 inserted into the opening 118 can keep the container 100 in the closed configuration. In still other embodiments, the container 100 can comprise tabs 506 and slits 508 in addition to apertures 116 that form an opening 118, or have latches, snaps, or any other desired connection mechanism to keep the container 100 in the closed configuration.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A food container comprising:

a first tray member coupled with a second tray member via a hinge mechanism;

said first and second tray members each comprising perimeter edges;

said perimeter edge of said first tray member being adapted to selectively couple with said perimeter edge of said second tray member; and said second tray member comprising a window, said window comprising a window panel enclosing a window opening in said second tray member;

wherein said first and second tray members each define an aperture adapted to at least partially engage a beverage vessel when said perimeter edges of said first and second tray members are coupled with each other; and wherein said apertures are openings extending entirely through said first and second tray members that are entirely enclosed by portions of said first and second tray members.

2. The food container of claim 1, wherein said window panel is a clear plastic sheet.

3. The food container of claim 1, further comprising at least one raised dividing member extending from an interior surface of at least one of said first and second tray members, said at least one raised dividing member being adapted to separate items placed within at least one of said first and second tray members.

4. The food container of claim 1, wherein at least one of said first and second tray members is comprised of plastic.

5. The food container of claim 1, wherein at least one of said first and second tray members is comprised of biodegradable material.

6. The food container of claim 1, wherein a tab member located on a perimeter edge of at least one of said first and second tray members enables said selectively coupling of said perimeter edges of said tray members.

7. The food container of claim 1, wherein said first and second tray members are adapted to selectively remain in a closed configuration via interference fit.

8. The food container of claim 1, wherein said first and second tray members are configured to remain in a closed configuration when said beverage vessel is engaged by both of said apertures.

9. The food container of claim 1, wherein when said perimeter edges of said first and second tray members are selectively coupled such that said first and second tray members are in a closed configuration and both of said apertures are at least partially engaging said beverage vessel, said closed configuration is maintained by the presence of said beverage vessel within said apertures.

10. The food container of claim 1, wherein said apertures in said first and second tray members are positioned such that both of said apertures form a single opening when said first and second tray members are in a closed configuration.

* * * * *